US008887543B2

(12) United States Patent
Kenny et al.

(10) Patent No.: US 8,887,543 B2
(45) Date of Patent: Nov. 18, 2014

(54) TUBE FLARING TOOL

(75) Inventors: Matthew Kenny, Greensboro, NC (US); John Rinehart, Burlington, NC (US)

(73) Assignee: Horizon Tool Inc., Greensboro, NC (US)

( * ) Notice: Subject to any disclaimer, the term of this patent is extended or adjusted under 35 U.S.C. 154(b) by 502 days.

(21) Appl. No.: 13/342,748

(22) Filed: Jan. 3, 2012

(65) Prior Publication Data

US 2012/0167654 A1 Jul. 5, 2012

Related U.S. Application Data

(60) Provisional application No. 61/460,316, filed on Jan. 3, 2011.

(51) Int. Cl.
*B21D 41/02* (2006.01)
*B21D 19/14* (2006.01)

(52) U.S. Cl.
CPC ..... *B21D 41/02* (2013.01); *B21D 41/021* (2013.01); *B21D 19/14* (2013.01)
USPC ..... 72/318; 72/322

(58) Field of Classification Search
CPC ..... B21D 41/02; B21D 41/021
USPC ..... 72/316–318, 322, 323, 370.1, 370.11
See application file for complete search history.

(56) References Cited

U.S. PATENT DOCUMENTS

| | | | | |
|---|---|---|---|---|
| 2,297,885 | A | 10/1942 | Graf et al. | |
| 2,430,168 | A | 11/1947 | Graham | |
| 2,737,225 | A | 3/1956 | Jasinski | |
| 2,861,623 | A | 11/1958 | Franck | |
| 2,932,338 | A * | 4/1960 | Franck | 72/322 |
| 3,913,364 | A * | 10/1975 | Strybel | 72/318 |
| 4,813,260 | A * | 3/1989 | Strybel | 72/316 |
| 6,199,421 | B1 * | 3/2001 | Ploeger | 72/317 |
| 6,966,210 | B2 | 11/2005 | Klann | |

FOREIGN PATENT DOCUMENTS

DE 32 30 444 A1 2/1984

* cited by examiner

*Primary Examiner* — Debra Sullivan
(74) *Attorney, Agent, or Firm* — Howard & Howard Attorneys PLLC

(57) ABSTRACT

A tool kit including a clamping structure formed of dual clamping bodies that define a cylindrical projecting member when the clamping bodies are united, a force transfer adapter, a substantially cylindrical force applying member having a tapered end and an elongated yoke having a longitudinal bore defined therein, wherein the first end of the yoke and the cylindrical projecting member have cooperating features for facilitating a non-permanent engagement with one another when the dual clamping bodies are united, and wherein the second end of the yoke and the force applying member include cooperating features for facilitating the gradual application of force to the force transfer adapter.

11 Claims, 6 Drawing Sheets

PRIOR ART

TUBE FLARING TOOL

CROSS-REFERENCE TO RELATED APPLICATIONS

This application claims the benefit of U.S. Provisional Patent Application No. 61/460,316 which was filed Jan. 3, 2011, the disclosure of which is incorporated herein by reference.

FIELD OF THE INVENTION

The invention relates generally to methods and devices for physically modifying a deformable material into a desirable physical shape, and more particularly, to a tool for forming a double flare configuration at an open end of a deformable tube.

BACKGROUND OF THE INVENTION

Fluid transfer in many applications is provided through metallic tubing. The metallic tubing may be fabricated of a suitable thickness to provide structural stability while also allowing for deformation or the physical modification thereof. For example, aluminum alloy tubing having between about ⅛ inch to about ⅜ inch outside diameter may be used as vehicle fluid transfer lines.

Physical modifications of tubing ends which are commonly referred to as the "single flare" and "double flare" are shown in FIG. 1. The double flare configuration in particular is most often used in fluid transfer lines made of metallic tubing and considered a standard in the automotive industry for connecting tubing with tubing fittings. For example, vehicle brake lines, transmission lines and fuel lines all employ metallic tubing with the ends having the double flare configuration.

The double flare configuration is desirable for forming a seal with the tubing fittings primarily because it provides resistance to the shearing effect of torque, enhances the retention of the tubing by the fitting, and prevents the cutting off of the flare and failure of the tube assembly under operating pressures, among other things.

As such, there is a continual need for methods and devices which better facilitate the formation of a double flare configuration on metallic tubing.

SUMMARY OF THE INVENTION

The invention is directed to methods and devices for physically modifying a deformable material into a desirable physical shape. In some embodiments, the invention is directed to a tool for forming a double flare shape at an open end of a deformable tube.

In some embodiments, the invention is directed to a tool kit including a clamping structure formed of dual clamping bodies that define a cylindrical projecting member when the clamping bodies are united, a force transfer adapter, a substantially cylindrical force applying member having a tapered end and an elongated yoke having a longitudinal bore defined therein, wherein the first end of the yoke and the cylindrical projecting member have cooperating features for facilitating a non-permanent engagement with one another when the dual clamping bodies are united, and wherein the second end of the yoke and the force applying member include cooperating features for facilitating the gradual application of force to the force transfer adapter.

In some embodiments, the invention is directed to a tool for physically modifying an open end of a portion of metallic tubing, which includes: a clamping structure including dual clamping bodies mounted for movement between a proximal tube retaining position with respect to one another and a distal tube releasing position with respect to one another, the clamping bodies having opposing side surfaces and elongated projecting members extending from the clamping bodies laterally with respect to one another, the opposing side surfaces and elongated projecting members having opposing tube engaging channels defined thereon, wherein the opposing tube engaging channels engage the portion of metallic tubing upon the dual clamping bodies being moved to the proximal tube retaining position; a force transfer adapter including a substantially cylindrical projection having a diameter at least less than the diameter of the open end of the portion of metallic tubing, a contact disc having a conical receiving cavity and a diameter at least greater than the diameter of the open end of the portion of metallic tubing, the contact disc having a surface in contact with the circular edge of the open end of the portion of the metallic tubing; an elongated force applying member having a tapered end; and an elongated yoke a first end, an opposing second end, and a longitudinal bore with a radially inner shoulder defined therein, the longitudinal bore having a first bore diameter configured and dimensioned for receiving the contact disc axially to the radially inner shoulder, the longitudinal bore having a second bore diameter from the second end to the radially inner shoulder configured and dimensioned for receiving the force applying member and guiding the tapered end of the force applying member into contact with the conical receiving cavity of the force transfer adapter.

In some embodiments, the first end of the yoke and the projecting members each include cooperating features for facilitating a non-permanent engagement with one another when the clamping bodies are in the proximal retaining position.

In some embodiments, the second end of the yoke and the force applying member include cooperating features for facilitating the gradual application of force to the contact disc.

In some embodiments, the dual clamping bodies the aforementioned tool are mounted to one another by at least one threaded fastener.

In some embodiments, the projecting members the aforementioned tool substantially have a half-cylindrical shape.

In some embodiments, the first bore diameter in the aforementioned tool is greater than the second bore diameter.

In some embodiments, the cooperating features in the aforementioned tool included on the first end of the yoke and the projecting members are corresponding threaded portions defined on the outer surfaces of the projecting members and on the inner surface of the longitudinal bore from the first end to the radially inner shoulder.

In some embodiments, the cooperating features for facilitating the gradual application of force to the contact disc in the aforementioned tool are corresponding threaded portions defined on the surface of the elongated force applying member and on the inner surface of the longitudinal bore from the second end to the radially inner shoulder.

The invention is also directed to a tool kit, which includes: a clamping structure including dual clamping bodies and at least one clamping fastener for causing the dual clamping bodies to move toward a proximal position with respect to one another, the clamping bodies having opposing side surfaces and elongated half-cylindrical projecting members extending from the clamping bodies laterally with respect to one another, the opposing side surfaces and elongated projecting members having opposing tube engaging channels defined thereon, wherein the elongated projecting members and opposing tube engaging channels form a cylindrical projecting member upon the dual clamping bodies being moved to the proximal position; a force transfer adapter including a substantially cylindrical projection, a first disc and a second contact disc, the cylindrical projection, the first disc and the second contact disc being substantially in a concentric relationship with respect to one another, wherein the second contact disc is of a greater diameter than the first disc and the first disc is of a greater diameter than the cylindrical projection; a substantially cylindrical force applying member having a tapered end; and an elongated yoke having a longitudinal bore defined therein, the longitudinal bore extending from a first end to an opposing second end, the first end having a bore diameter configured and dimensioned for receiving the second contact disc therein, with the radially outer peripheral edge of the second contact disc contacting the radially inner surface of the bore, and a second end having a bore diameter configured and dimensioned for receiving the force applying member and guiding the tapered end of the force applying member into contact with a central portion of the second contact disc of the force transfer adapter.

In some embodiments, the first end of the yoke and the cylindrical projecting member includes cooperating features for facilitating a non-permanent engagement with one another when the dual clamping bodies are in the proximal position. The cooperating features included on the first end of the yoke and the projecting members comprise corresponding threaded portions defined on the outer surfaces of the projecting members and on the inner surface of the longitudinal bore adjacent to the first end.

In some embodiments, the second end of the yoke and the force applying member include cooperating features for facilitating the gradual application of force to the second contact disc.

In some embodiments of the aforementioned tool kit, the first end bore diameter is greater than the second end bore diameter to axially divide the longitudinal bore of the yoke and define a radially inner surface therein.

The invention is also directed to other embodiments of a tool or tool kit, such as an exemplary tool kit including: a clamping structure including dual clamping bodies and at least one clamping fastener for causing the dual clamping bodies to be clamped to one another, the clamping bodies having opposing side surfaces and elongated half-cylindrical projecting members extending from the clamping bodies laterally with respect to one another, the opposing side surfaces and elongated projecting members having opposing tube engaging channels defined thereon, wherein the elongated projecting members and opposing tube engaging channels form a cylindrical projecting member upon the dual clamping bodies being clamped to one another; a force transfer adapter including a substantially cylindrical projection, a first disc and a second contact disc, the cylindrical projection, the first disc and the second contact disc being substantially in a concentric relationship with respect to one another, the second contact disc including a conical receiving cavity, wherein the second contact disc is of a greater diameter than the first disc and the first disc is of a greater diameter than the cylindrical projection; a drive screw having an elongated body and a tapered end; and an elongated yoke a first end, an opposing second end, and a longitudinal bore with a radially inner shoulder defined therein, the longitudinal bore having a first bore diameter configured and dimensioned for receiving the second contact disc axially to the radially inner shoulder, the longitudinal bore having a second bore diameter from the second end to the radially inner shoulder configured and dimensioned for receiving the drive screw and guiding the tapered end of the drive screw into contact with the conical receiving cavity of the second contact disc of the force transfer adapter.

In some embodiments of this exemplary tool kit, the inner surface of the longitudinal bore from the first end of the yoke to the radially inner shoulder includes threads for facilitating a non-permanent engagement with the cylindrical projecting member formed upon the dual clamping bodies being clamped to one another.

In some embodiments of this exemplary tool kit, the inner surface of the longitudinal bore from the second end of the yoke to the radially inner surface includes threads for facilitating a non-permanent engagement with the drive screw for the gradual application of force to the second contact disc.

In some embodiments of this exemplary tool kit, the first bore diameter is greater than the second bore diameter.

These and other unique features of the invention will become more readily apparent from the following description of the drawings taken in conjunction with the detailed description.

DETAILED DESCRIPTION OF THE INVENTION

Figure 1:
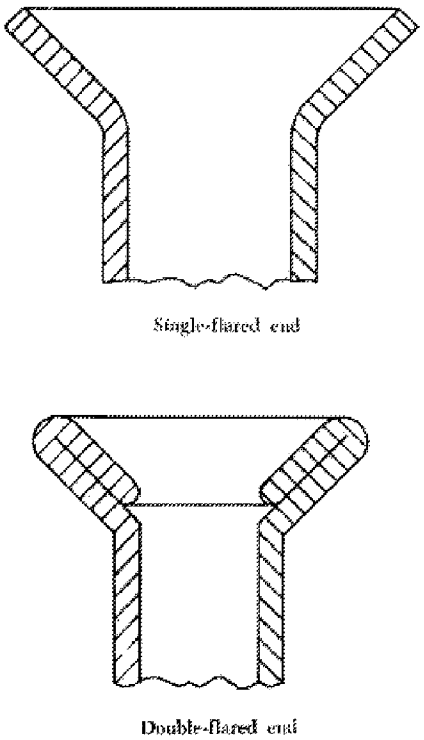
FIG. 1 is a cross-sectional view of two portions of tubing illustrating a single flare configuration and a double flare configuration at the open end of each portion of tubing.
Figure 3:
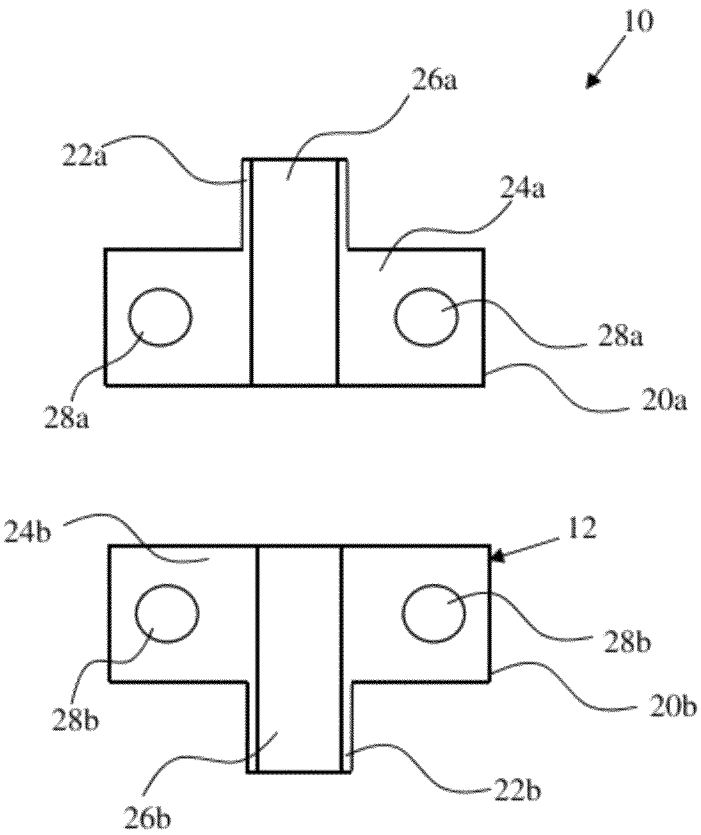
FIG. 3 is an front side schematic view of the clamping bodies shown in FIG. 2.
Figure 2:
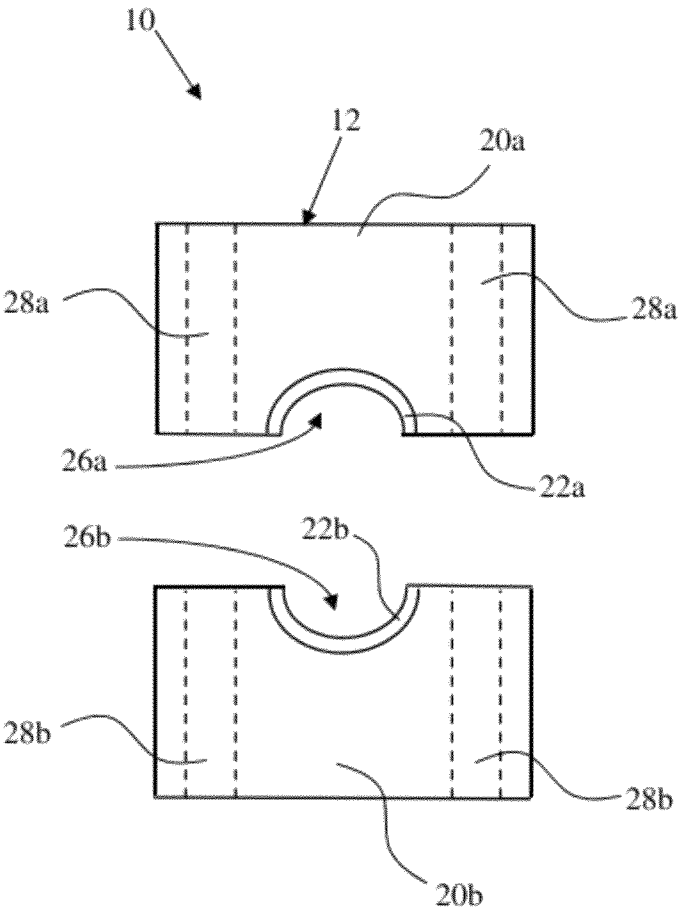
FIG. 2 is an top schematic view of the clamping bodies used in the clamping structure of an exemplary embodiment of the invention.
Figure 4:
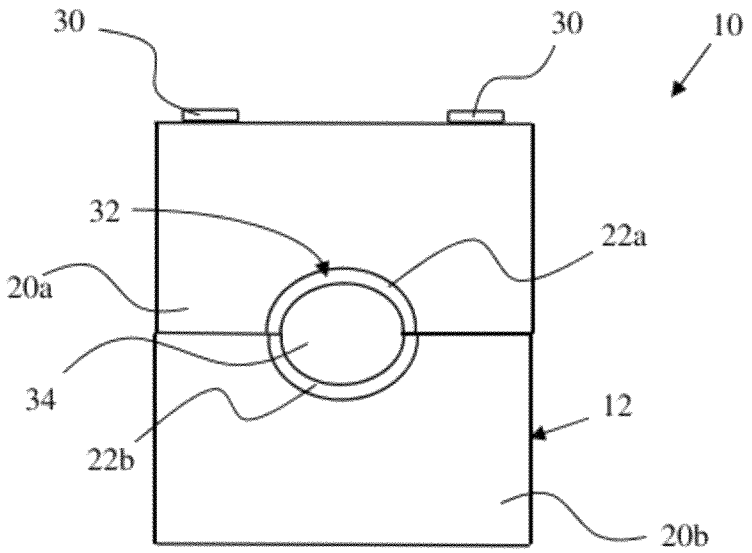
FIG. 4 is a top elevational view of the clamping bodies of FIG. 2 in a proximal position relative to one another and forming a central cylindrical neck.
Figure 11:
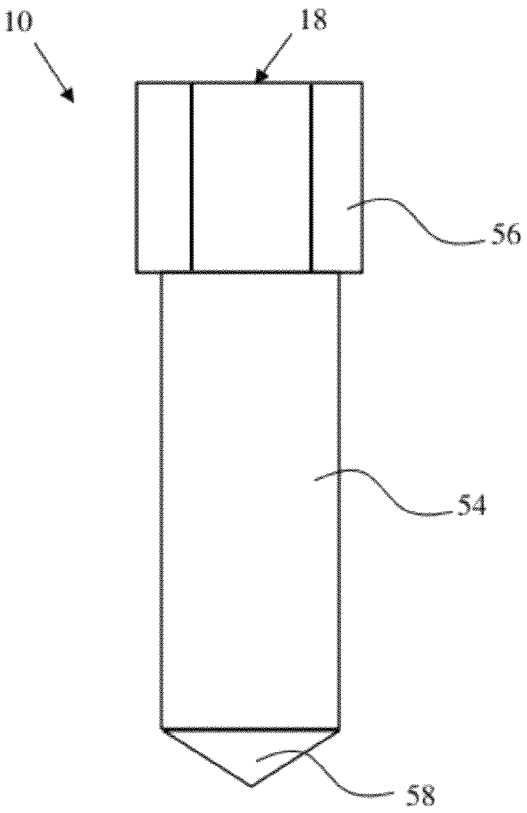
FIG. 11 is a side elevational view of the force applying member used in an exemplary embodiment of the invention.
Figure 5:
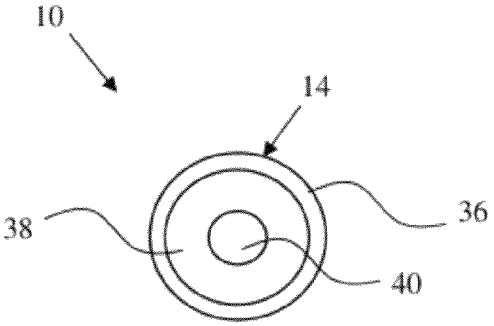
FIG. 5 is a top elevational view of the force transfer adapter used in an exemplary embodiment of the invention.
Figure 6:
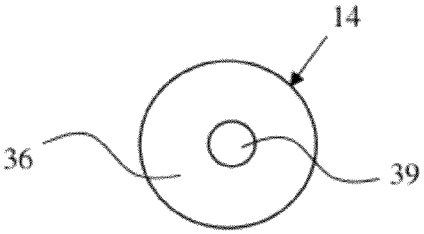
FIG. 6 is a bottom elevational view of the force transfer adapter of FIG. 5.
Figure 7:
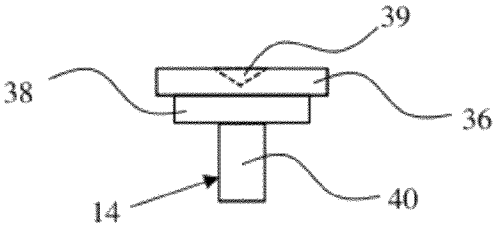
FIG. 7 is a side elevation view of the force transfer adapter of FIG. 5.
Figure 10:
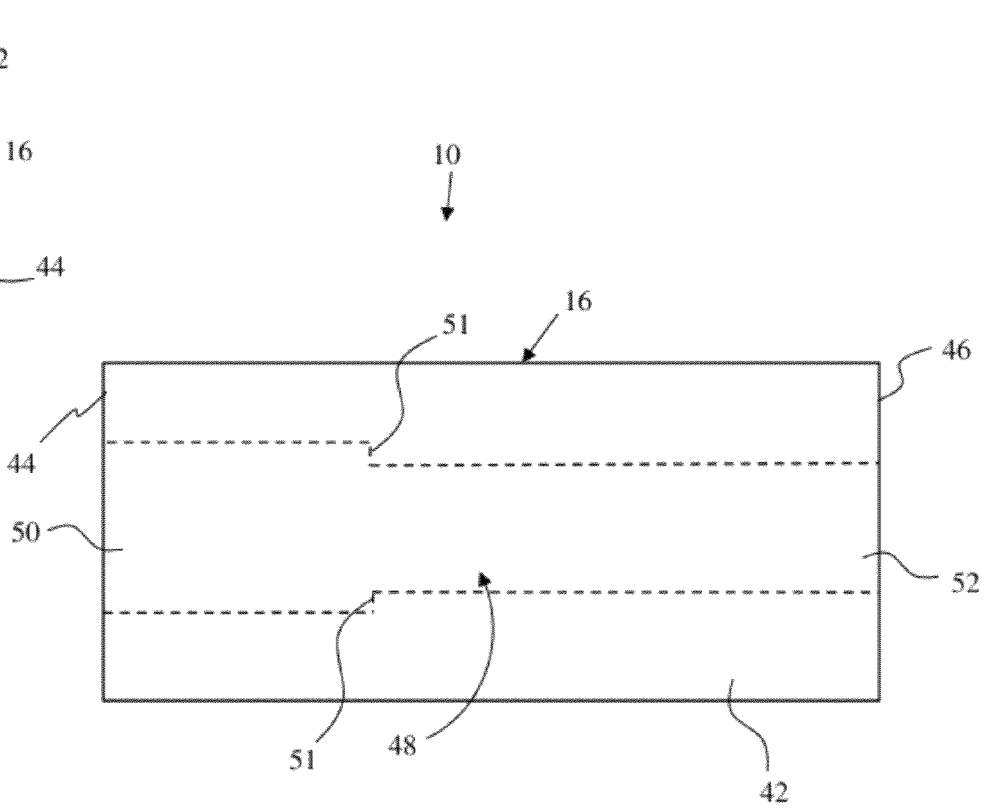
FIG. 10 is a side schematic view of the yoke of FIG. 7.
Figure 8:
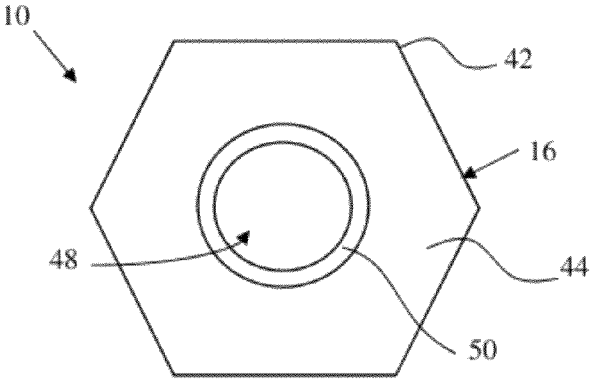
FIG. 8 is a bottom elevational view of the yoke used in an exemplary embodiment of the invention.
Figure 9:
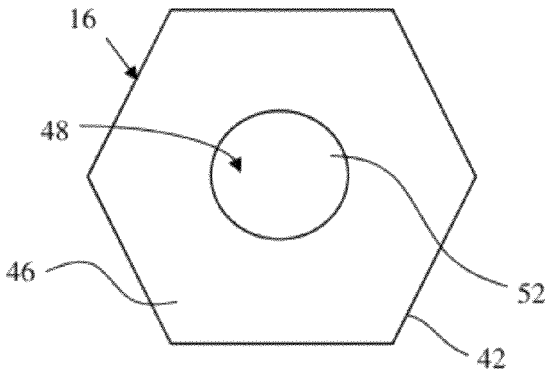
FIG. 9 is a top elevational view of the yoke of FIG. 7.

While the disclosure is sufficiently detailed to enable those skilled in the art to practice the invention, it should be understood that the physical embodiments herein disclosed merely exemplify the invention which may also be embodied in and by other specific structures. Additionally, references to order, such as "first" or "second," and positional references, such as "upper" and "lower", are merely used for illustrative convenience and not intended to be limiting of the features and parts of embodiments herein to any particular order or relative position.

A tool or kit according to some embodiments of the invention is generally referred to by the reference numeral 10 in FIGS. 2-14. In this embodiment, tool 10 includes a tube clamping structure 12, a force transfer adapter 14, a yoke 16 and force applying member 18.

Tube clamping structure 12 includes dual opposing clamping bodies 20*a* and 20*b*. Clamping bodies 20*a* and 20*b* each include an elongated member 22*a,b* which projects from bodies 20*a* and 20*b* at a side surface 24*a,b* thereof. Side surfaces 24*a,b* and elongated members 22*a,b* have a tube receiving channel 26*a,b* formed therein, thus defining elongated members 22*a,b* as half-cylindrical in shape.

In this embodiment, bore holes 28*a,b* are configured for receiving threaded fasteners 30 through bore holes 28*a* which extend through clamping bodies 20*a* and into bore holes 28*b* of body 20*b*, with bore holes 28*b* of body 20*b* having cooperating threaded inner surfaces for mating with fasteners 30. While fasteners 30 in this embodiment are set screws, and in particular hex shaped set screws, it should be understood that one set screw may be used, as well as other mechanical fastening methods and apparatus may be employed, without departing from the scope and spirit of the invention. Additionally, the threads described herein may be of any conventional type or other helical ridge, and may be straight or tapered. Fasteners 30 are used to bring clamping bodies 20*a* and 20*b* from a distal position with respect to one another to a proximal position with respect to one another, thus securing bodies 20*a* and 20*b* against one another with elongated members 22*a,b* abutting and uniting to form a single cylindrical neck 32 having receiving channels 26*a,b* defining a tubular cavity 34 therein with opposing open ends, as shown particularly in FIG. 4.

Adapter 14 includes an upper disc member 36 and an abutting lower disc member 38 positioned concentrically with respect to one another. In this embodiment, lower disc 38 has a diameter which is less than the diameter of upper disc 36. Adapter 14 includes a central cylinder 40 which projects from the center of lower disc 38 along a substantially perpendicular axis with respect to the circular surface of lower disc 38. Adapter 14 also includes a substantially conical shaped receiving cavity 39 in upper disc member 36 substantially defined in a central location in the surface of upper disc member 36 opposing lower disc member 38.

Yoke 16 includes an elongated body 42 which may be substantially cylindrical with a hexagonal cross-section as shown herein. Yoke body 42 has a first end 44 and a second opposing end 46 with a central bore 48 defined therein from first end 44 to second end 46. In this embodiment, central bore 48 includes a clamping apparatus receiving bore portion 50 adjacent to first end 44, and a force applying member receiving bore portion 52 adjacent to second end 46. Bore portion 50 is configured and dimensioned for receiving cylindrical neck 32 and has a diameter which is greater than but similar to the diameter of upper disc 36. The diameter of bore portion 50 allows for axial movement of upper disc 36 within bore portion 50 until reaching a radially inner circular surface or shoulder 51, while restricting lateral and pivotal movement of upper disc 36 and adapter 14 when placed within bore portion 50 as a result of such features. Shoulder 51 provides an axial division point of bore 48 into bore portions 50 and 52, respectively. Bore portion 50 may extend longitudinally within yoke body 42 a length substantially similar to the length of neck 32 plus the combined widths of disc members 36 and 38.

At second end 46 of yoke 16, bore portion 52 is configured and dimensioned to receive force applying member 18 therein. In this embodiment, the diameter of force applying member 18 is less than the diameter of upper disc 36, and the diameter of bore portion 52 is therefore less than the diameter of bore portion 50. Bore portion 52 may extend within yoke body 42 a length equal to the length of the force applying member 18.

Force applying member 18 in this embodiment is substantially a drive screw with an elongated body 54, hexagonal head 56 and a tapered contact tip 58. Elongated body 54 includes threads defined on its surface which cooperate with corresponding threads defined on the inner surface of bore portion 52 so that elongated body 54 with contact tip 58 can be driven axially through bore portion 52.

Figure 12:
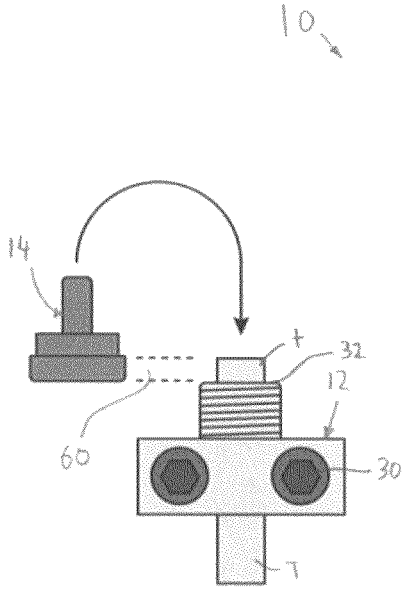
FIGS. 12, 13 and 14 are schematic views illustrating exemplary operative steps for using the tool and components shown in FIGS. 2-11.
Figure 13:
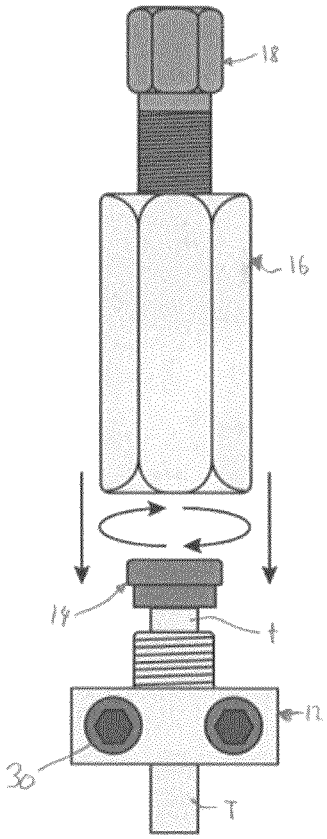
Figure 14:
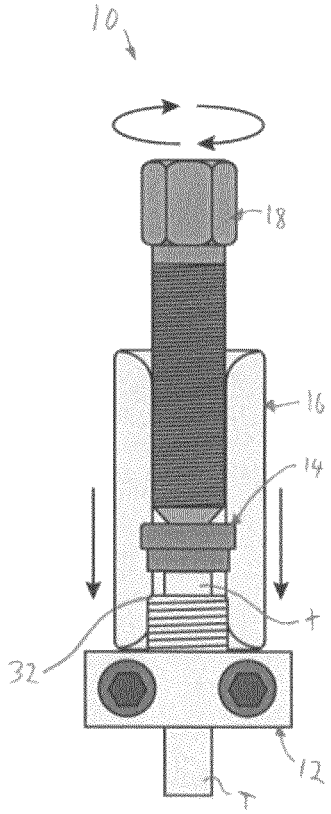

As shown in FIGS. 12-14, a portion of tubing "T" is positioned between receiving channels 26*a,b* and secured through contact therewith upon clamping bodies 20*a,b* being positioned in a proximal or clamped position with respect to one another via fasteners 30. Tubing T is positioned so that a portion thereof adjacent to its open end, identified as tube portion "t" in the figures, extends axially from neck 32 and is exposed. In this embodiment, the width of upper disc 36 may be configured for use as a measuring guide of a desirable axial length of tube portion t to have extending from neck 32, as identified by arrow 60 in FIG. 12.

Adapter 14 is at seated on the open end of tube portion t as shown by the arrow in FIG. 12 so that lower disc 38 contacts the peripheral edge of the open end of tube portion t and central cylinder 40 extends into tube portion t. In this embodiment, bore portion 50 of yoke 16 includes threads defined on the inner surface thereof which cooperate with corresponding threads on the outer surface of elongated members 22*a,b* when united to form neck 32, thus allowing yoke 16 to be non-permanently mated with clamping structure 12 as shown by the arrows in FIG. 12. Yoke 16 is therefore screwed axially downward along neck 32 to further secure adapter 14 and tube portion t therein with a portion of the radially outer surface of upper disc 36 being brought into contact with shoulder 51 for additional restraint thereof. As shown by arrows in FIG. 13, force applying member 18 is driven axially through bore portion 52 until contact tip 58 transverses shoulder 51 and is received and partially engaged within conical cavity 39 of adapter 14. The engagement with conical cavity 39 further facilitates the application of force in the axial direction while restricting lateral or pivotal motion of adapter 14 and member 18, among other things. By tightening member 18 within bore portion 52, member 18 gradually applies force to adapter 14 which is transferred through lower disc 38 to the open end of tube t through contact therewith.

It is through this gradual application of force via member 18, directed through yoke 16 onto tube portion t through adapter 14 which is securely seated thereon, that the open end is physically modified to form a single flare configuration (i.e., wherein the end has a radially outward portion).

In forming a double flare configuration (i.e., wherein the end has a radially outward portion and a radially inward portion, defining a resting surface or seat at the outer end surface of the tubing on the inwardly deformed portion), force applying member 18 is unscrewed or otherwise partially retreated from its position after force applying member 18 is driven axially into adapter 14 to form a single flare configuration so that it is no longer applying force to adapter 14. Yoke 16 is unscrewed from neck 32 with force applying member 18 remaining engaged therein. Adapter 14 is removed from its position on tube portion t. Yoke 16 is then reattached to neck 32 and force applying member 18 is driven axially into tube portion t so that contact tip 58 physically modifies the opening of tube portion t from a single flare configuration to the double flare configuration.

Through features described herein and its low profile, among other things, tool 10 advantageously permits the flaring of metallic tubing while in place within its intended application, such as a vehicle. It should be understood that the tool and tool kits described herein may be used in combination with metallic tubing or other deformable materials as well.

While embodiments of the tool and exemplary components thereof have been described herein, it should also be understood that the foregoing is only illustrative of a particular embodiments with exemplary and/or preferred features, as well as principles of the invention, and that various modifications can be made by those skilled in the art without departing from the scope and spirit of the invention. Therefore, the described embodiment and components thereof should not be considered as limiting of the scope of the invention in any way. Accordingly, the invention embraces alternatives, modifications and variations which fall within the spirit and scope of the invention as set forth in the claims and equivalents thereto.

What is claimed is:

1. A tool for physically modifying an open end of a portion of metallic tubing, comprising:

(a) a clamping structure including dual clamping bodies mounted for movement between a proximal tube retaining position with respect to one another and a distal tube releasing position with respect to one another, the clamping bodies having opposing side surfaces and elongated projecting members extending from the clamping bodies laterally with respect to one another, the opposing side surfaces and elongated projecting members having opposing tube engaging channels defined thereon, wherein the opposing tube engaging channels engage the portion of metallic tubing upon the dual clamping bodies being moved to the proximal tube retaining position;

(b) a force transfer adapter including a substantially cylindrical projection having a diameter at least less than the diameter of the open end of the portion of metallic tubing and a contact disc having a diameter at least greater than the diameter of the open end of the portion of metallic tubing, the contact disc having a conical receiving cavity and an opposing surface in contact with the circular edge of the open end of the portion of the metallic tubing;

(c) an elongated force applying member having a tapered end; and (d) an elongated yoke including a first end, an opposing second end, and a longitudinal bore with a radially inner shoulder defined therein, the longitudinal bore having a first bore diameter configured and dimensioned for receiving the contact disc axially to the radially inner shoulder, the longitudinal bore having a second bore diameter from the second end to the radially inner shoulder configured and dimensioned for receiving the force applying member and guiding the tapered end of the force applying member into contact with the conical receiving cavity of the force transfer adapter, wherein the first end of the yoke and the projecting members each include cooperating features for facilitating a non-permanent engagement with one another when the clamping bodies are in the proximal retaining position, and wherein the second end of the yoke and the force applying member include cooperating features for facilitating the gradual application of force to the contact disc.

2. A tool as recited in claim 1, wherein the dual clamping bodies are mounted to one another by at least one threaded fastener.

3. A tool as recited in claim 1, wherein the projecting members substantially have a half-cylindrical shape.

4. A tool as recited in claim 1, wherein the first bore diameter is greater than the second bore diameter.

5. A tool as recited in claim 1, wherein the cooperating features included on the first end of the yoke and the projecting members further comprise corresponding threaded portions defined on the outer surfaces of the projecting members and on the inner surface of the longitudinal bore from the first end to the radially inner shoulder.

6. A tool as recited in claim 1, wherein the cooperating features for facilitating the gradual application of force to the contact disc further comprise corresponding threaded portions defined on the surface of the elongated force applying member and on the inner surface of the longitudinal bore from the second end to the radially inner shoulder.

7. A tool kit, comprising:

(a) a clamping structure including dual clamping bodies and at least one clamping fastener for causing the dual clamping bodies to move toward a proximal position with respect to one another, the clamping bodies having opposing side surfaces and elongated half-cylindrical projecting members extending from the clamping bodies laterally with respect to one another, the opposing side surfaces and elongated projecting members having opposing tube engaging channels defined thereon, wherein the elongated projecting members and opposing tube engaging channels form a cylindrical projecting member upon the dual clamping bodies being moved to the proximal position;

(b) a force transfer adapter including a substantially cylindrical projection, a first disc and a second contact disc, the cylindrical projection, the first disc and the second contact disc being substantially in a concentric relationship with respect to one another, wherein the second contact disc is of a greater diameter than the first disc and the first disc is of a greater diameter than the cylindrical projection;

(c) a substantially cylindrical force applying member having a tapered end; and (d) an elongated yoke having a longitudinal bore defined therein, the longitudinal bore extending from a first end to an opposing second end, the first end having a bore diameter configured and dimensioned for receiving the second contact disc therein, with a radially outer peripheral edge of the second contact disc contacting a radially inner surface of the bore, and a second end having a bore diameter configured and dimensioned for receiving the force applying member and guiding the tapered end of the force applying member into contact with a central portion of the second contact disc of the force transfer adapter, wherein the first end of the yoke and the half-cylindrical projecting member includes cooperating features for facilitating a non-permanent engagement with one another when the dual clamping bodies are in the proximal position, and wherein the second end of the yoke and the force applying member include cooperating features for facilitating the gradual application of force to the second contact disc.

8. A tool kit as recited in claim 7, wherein the cooperating features included on the first end of the yoke and the projecting members comprise corresponding threaded portions defined on the outer surfaces of the projecting members and on the inner surface of the longitudinal bore adjacent to the first end.

9. A tool kit as recited in claim 7, wherein the first end bore diameter is greater than the second end bore diameter to axially divide the longitudinal bore of the yoke and define the radially inner surface therein.

10. A tool kit, comprising:

(a) a clamping structure including dual clamping bodies and at least one clamping fastener for causing the dual clamping bodies to be clamped to one another, the clamping bodies having opposing side surfaces and elongated half-cylindrical projecting members extending from the clamping bodies laterally with respect to one another, the opposing side surfaces and elongated projecting members having opposing tube engaging channels defined thereon, wherein the elongated projecting members and opposing tube engaging channels form a cylindrical projecting member upon the dual clamping bodies being clamped to one another;

(b) a force transfer adapter including a substantially cylindrical projection, a first disc and a second contact disc, the cylindrical projection, the first disc and the second contact disc being substantially in a concentric relationship with respect to one another, a conical receiving cavity being defined on the second contact disc, wherein the second contact disc is of a greater diameter than the first disc and the first disc is of a greater diameter than the cylindrical projection;

(c) a drive screw having an elongated body and a tapered end; and (d) an elongated yoke including a first end, an opposing second end, and a longitudinal bore with a radially inner shoulder defined therein, the longitudinal bore having a first bore diameter configured and dimensioned for receiving the second contact disc axially to the radially inner shoulder, the longitudinal bore having a second bore diameter from the second end to the radially inner shoulder configured and dimensioned for receiving the drive screw and guiding the tapered end of the drive screw into contact with the conical receiving cavity of the second contact disc of the force transfer adapter, wherein the inner surface of the longitudinal bore from the first end of the yoke to the radially inner shoulder includes threads for facilitating a non-permanent engagement with the cylindrical projecting member formed upon the dual clamping bodies being clamped to one another, and wherein the inner surface of the longitudinal bore from the second end of the yoke to the radially inner surface includes threads for facilitating a non-permanent engagement with the drive screw for the gradual application of force to the second contact disc.

11. A tool kit as recited in claim 10, wherein the first bore diameter is greater than the second bore diameter.

* * * * *